United States Patent [19]

Quaggiotti

[11] Patent Number: 5,037,124

[45] Date of Patent: Aug. 6, 1991

[54] FOLDABLE SKI

[75] Inventor: Vittorio Quaggiotti, Padua, Italy

[73] Assignee: S.B.P. S.r.l., Padua, Italy

[21] Appl. No.: 460,247

[22] Filed: Jan. 2, 1990

[30] Foreign Application Priority Data

Jan. 18, 1989 [IT] Italy ..... 19113 A/89

[51] Int. Cl.[5] ..... A63C 5/02

[52] U.S. Cl. ..... 280/603; 280/602

[58] Field of Search ..... 280/602, 603, 607, 609, 280/15, 16, 28.14

[56] References Cited

U.S. PATENT DOCUMENTS 3,336,036 8/1967 Manfreda ..... 280/607
3,438,643 4/1969 Spietts ..... 280/16
3,560,012 2/1971 Auer ..... 280/16
4,725,069 2/1988 Stampacchia ..... 280/607
4,878,686 11/1989 Quaggiotti ..... 280/602

*Primary Examiner*—David M. Mitchell
*Attorney, Agent, or Firm*—Beveridge, DeGrandi & Weilacher

[57] ABSTRACT

A foldable ski structure comprising a front slide and a rear slide connected by an intermediate link arm which maintains the two slide sections of the ski in a longitudinally aligned condition; the intermediate link arm is hinged to the front slide and to the rear slide of the ski to enable the ski to be folded; engageable and disengageable hooking members are provided between the intermediate link arm, the front slide and respectively between the intermediate link arm and the rear slide of the ski.

15 Claims, 3 Drawing Sheets

FOLDABLE SKI

BACKGROUND OF THE INVENTION

This invention refers to a ski structure formed in two parts which are linked in order to enable the ski to be folded in half for minimum bulk.

A conventional ski basically comprises one single slide, which extends continuously from the front end to the rear end of the ski. This ski is therefore uniquely based both on its structural continuity and on the continuity of its elastic properties as well as the lower sliding surface including the lateral blades on the side edges of the ski. A conventional ski therefore has constant dimensions of length which correspond to the maximum dimensions of the ski, which under no circumstances can be reduced or modified. Therefore the transport of skis requires a special ski-rack to be mounted on the car roof, since it is not always possible to place skis inside and may in any case be dangerous and result in damage or injury. Carrying skis on the shoulders of the skier on the ski-slopes may be also uncomfortable and inconvenient.

It would therefore be desirable to make available a ski capable of the performances of a conventional ski or rather improving on them, and which at the same time can be folded in half with minimum bulk to facilitate transport.

In this respect, the use of a simple intermediate connecting hinge between the two separate parts of a conventional ski, even if it has never been proposed, would not solve the problem of adequately folding the ski when not in use, at the same time maintaining unchanged the structural and functional characteristics of a conventional ski. In fact, the presence of an intermediate hinge would involve an inadmissible discontinuity in the flexible structure and could not however be restored since it would be virtually impossible to match the edges and side blades of the two separated ski parts perfectly, thus rendering the skis practically useless.

Likewise, from a previous European patent application 258648 of the same applicant, is known a ski composed of two separate slides joined by an intermediate link arm hinged to the front slide in proximity of its centre line and fixedly or hingedly connected to the front end of the rear slide; each slide has at its front end an upwardly turned tip portion which solves the problem of discontinuity of the lower sliding surface and of the lateral blades of the ski. The use of elastic or semi-elastic pad means between the intermediate arm and both slides, enables to restore the continuity of the structural characteristics of the ski. This ski structure also has constant length and cannot be folded in half for minimum bulk.

After various attempts and experiments, it has now been discovered that basing on a ski structure in two parts, for example according to the previous European patent application 258648, by modifying the configuration and disposition of the hinges and intermediate link arm, a foldable ski structure may be obtained at the same time designed to meet the requirement of folding the ski in half for minimum longitudinal bulk, when the ski is not in use, and to maintain unchanged, or rather improve, the characteristics of structure, flexibility and functionality of a conventional ski.

SUMMARY OF THE INVENTION

These objects can be achieved by means of a foldable ski comprising a front slide having an upwardly turned tip portion, a rear slide having an upwardly turned tip portion, and an intermediate link arm hinged to the front slide and to the rear slide to maintain said slides longitudinally aligned, and means for limiting movement between said arm and said slides , said movement limiting means comprising hooking members which can be engaged and disengaged between said arm and said front and rear slides, the hinge axis of the hooking member and of said arm to the rear slide being positioned in longitudinally spaced apart points of the tip portion of the rear slide; other characteristics and particular embodiments are defined in the dependent claims.

BRIEF DESCRIPTION OF THE DRAWINGS

The ski according to this invention is to be described in greater detail further on, with reference to the examples of the annexed drawings related to the ski of the previous patent application, whose characteristics are claimed together with the innovatory characteristics of the ski according to this application.

In the drawings.

DESCRIPTION OF THE INVENTION

Figure 1:
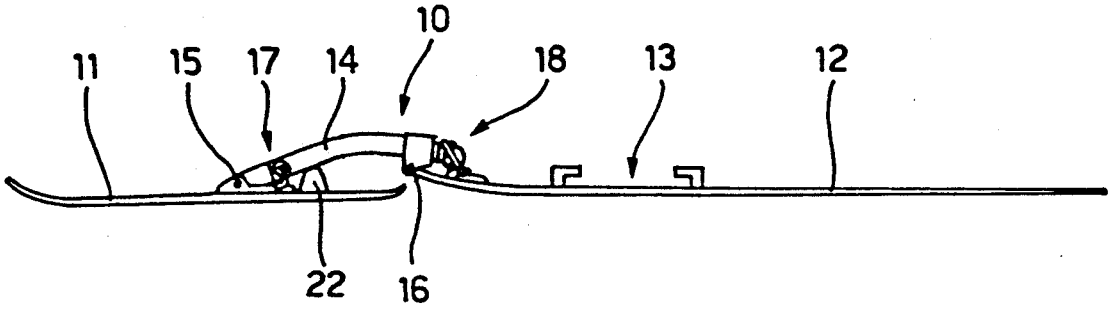
FIG. 1 is a side view of a ski in extended condition.
Figure 2:
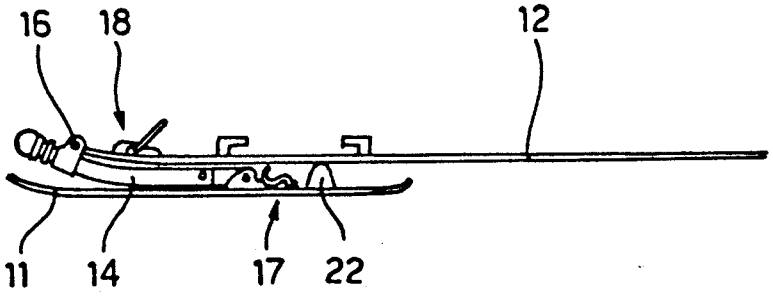
FIG. 2 is a side view of the ski of FIG. 1 in folded condition.

With reference to FIGS. 1 and 2 the ski is normally indicated by the number 10 and comprises a front ski part or slide 11, and a rear ski part or slide 12 which is spaced apart for a short length from the rear end of the front slide 11. The rear slide 12 is of greater length than the front slide 11 extending beyond the central point of the ski; 13 indicates the bindings for the ski-boot which in this case are also fixed directly to the rear slide 12 in proximity of the tip portion; 14 indicates an intermediate link arm or connecting element between the front slide 11 and the rear slide 12; the arm 14 is hinged in 15 in an intermediate position to the front slide 11, whereas in 16 it is hinged to the front edge of the tip portion of the rear slide 12 in order to enable said arm 14 to pivot and the front slide 11 to fold against the rear slide 12 for minimum bulk as shown in FIG. 2.

Each slide 11 and 12 of the ski, corresponding to the ski slides of the previous European patent application, has an upwardly turned tip portion having side edges curved outwards. The hinges 15 and 16 for linking arm 14 to the two slides 11 and 12 have their rotational axis crosswise to the longitudinal direction of the ski so as to maintain the slides 11 and 12 perfectly aligned during use maintaining the hinges in proximity of the plane of the same slides.

As indicated schematically by 17 and 18 in FIGS. 1 and 2, the ski comprises means for limiting movement and rotation between the intermediate arm 14 and the slides 11 and 12 when the ski is in use, enabling the ski itself to be folded; these movement limiting means therefore comprise hooking members which can engage and disengage with arm 14 to enable the ski to be extended and to be folded. The hooking elements are indicated by 17 for the front hinging 15 and by 18 for the rear hinging 16 of the link arm 14. The link arm 14 in the solution in FIG. 1 also has a curved configuration in order to adapt to the curve or longitudinal profile of the tip portion of the rear slide 12 as clearly shown in the various figures.

Figure 3:
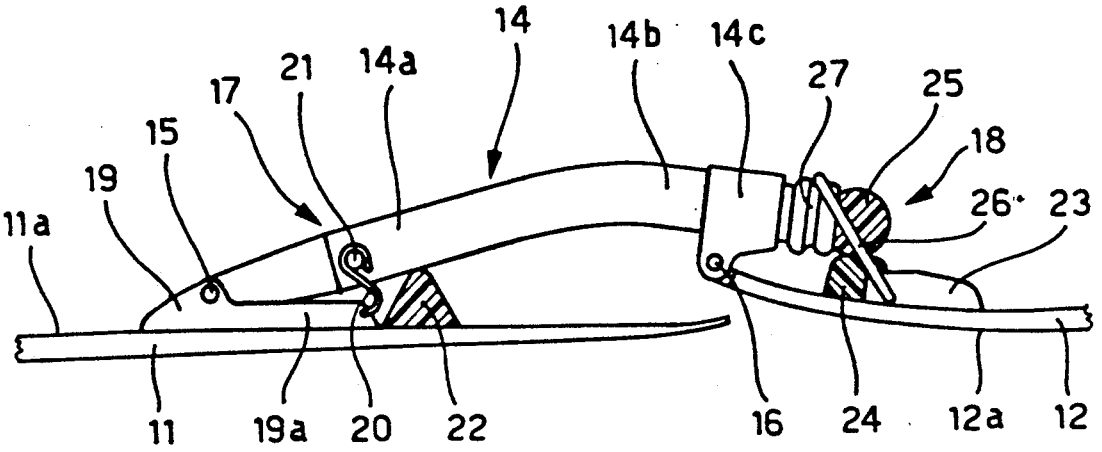
FIG. 3 is an enlarged view of the intermediate link arm between the two parts of the ski, in the extended condition of FIG. 1.
Figure 4:
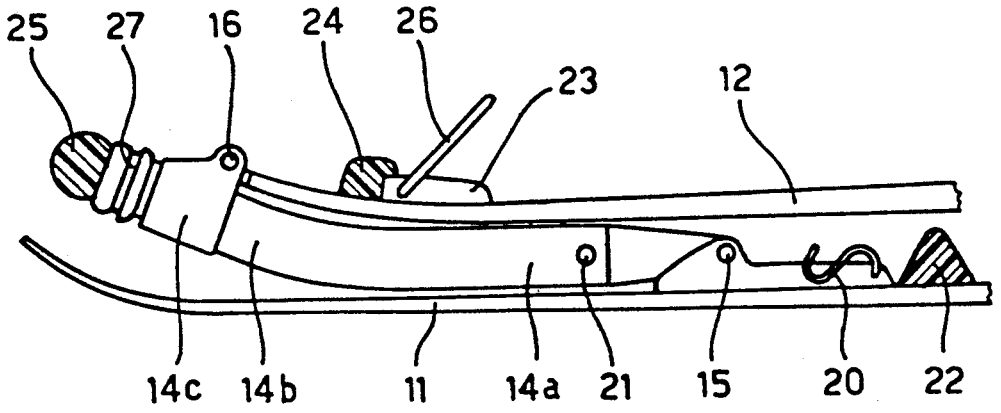
FIG. 4 is an enlarged view of the intermediate link arm with the ski in the folded condition of FIG. 2.

FIGS. 3 and 4 of the drawings illustrate in greater detail some of the possible characteristics of the ski according to the invention.

As can be seen from said figures, the intermediate link arm 14 is hinged at 15 to a bracket 19 fastened to the upper surface of the front ski slide 11. The bracket 19 extends at the rear with a part 19*a* at the end of which an elastically engageable hooking member 20 has been hinged, which engages and disengages from transverse pins 21 provided on both sides of the arm 14. Behind the bracket 19 there is provided a biasing pad means 22 fixed to the rear part of slide 11, against which the link arm 14 rests. The pad means 22 can however be made from any suitable material, for example an elastomeric material having sufficient rigidity to enable, in combination with the hooking element 21, a suitable and different two-way action for restricting the rotational movement between the front slide 11 and the arm 14, that is to say acting in both directions of rotation of the arm 14, but with different intensities.

The arm 14 linking the two slides has in turn a front portion 14*a* of a substantially linear configuration which conforms to the front part of the runner 11; the said hinge 15 is positioned on the bracket 19 at a sufficient distance from the upper surface 11*a* of the slide, to enable the front part 14*a* of the linking arm to fold parallel to and against the upper surface 11*a* of the same slide. In other words, the hinge 15 must lie substantially aligned with the front part 14*a* of the arm 14 linking the slides; in this way, as clarified further on and illustrated in FIG. 2, a substantially parallel and side positioning of the two slides 11 and 12 is allowed, in the folded condition as shown in FIGS. 2 and 4.

Moreover, FIGS. 3 and 4 show the rear end 14*b* of the arm 14 forms an angle or a curve in relation to the front part 14*a* and is fixed to a sleeve or connecting element 14*c*, hinged at 16 to the front edge of the upwardly turned tip portion of the rear slide 12.

As illustrated in the detail of FIG. 3, the axis of the hinge 15 lies in the proximity of or is caused to substantially coincide with the plane of the ski, at its front edge, and is positioned on one side of the arm 14 at a certain distance from its longitudinal axis in such a way as to enable the said arm to fold towards and against the lower surface 12*a* of the rear slide 12. In particular the distance between the hinging axis 16 and the longitudinal axis of the rear part 14*a* of the arm must be such so as to enable the front part 14*a* of the arm to be positioned parallel, against or in close proximity of the lower surface 12*a* of the rear slide. This disaligned arrangement of the hinges, in relation to the slide for the front hinge, and respectively in relation to the intermediate link arm 14 for the rear hinge, as also the arched or angled conformation of the arm 14, enable the ski to be folded and a parallel or close position of the slides when the ski is folded, which reduces bulk both longitudinally and transversely to a minimum.

Similarly to what is envisaged for hinging between the arm 14 and the front slide 11, also for the rear slide suitable means are provided for restricting or limiting the movement of rotation which comprise hooking elements which can be engaged and disengaged to enable the two slide to be aligned, when the ski is in use as shown in FIG. 1, and a folded disposition as in FIG. 2. Therefore here too the means 18 for restricting the movement comprising for example a bracket 23 fixed at a certain distance from the front edge of the tip of the slide 12; to said bracket 23 is fixed a pad member 24, preferably in an elastomeric material, which serves as a rest or stop element for a similar pad 25 possibly also in elastomeric material, fixed to the end of the arm 14 protruding backwards through the connecting part 14*c*. An hooking element 26, for example of annular shape, can be hinged to the bracket 23 to engage in an annular groove 27 provided at the projecting rear end of the arm 14 or a part joined to it, so that the resting buffer 25 is maintained in close contact with the stop pad 24, preventing the hooking ring 26 from disengaging.

In this case too the parts 24 and 25 can be made in elastomeric material of suitable rigidity and sufficient flexibility to enable, in combination with the hooking element 26, a rigid or semi-rigid connection, that is to say with a limited degree of elasticity, between the rear slide 12 and the intermediate link arm 14.

FIG. 4 shows the same parts as in FIG. 3 in the position which these assume when the ski is folded as in FIG. 2. Thus in FIG. 4 the same reference numbers indicate parts corresponding to those in the previous figures.

The use of the ski is substantially the following: as shown in FIGS. 1 and 3, the two slides 11 and 12 are aligned longitudinally, and rigidly fixed by the intermediate link arm 14 and by the action of the hooking members of the movement limiting means 17 and 18. Under these conditions the ski in FIG. 1 can be used as a traditional snow-ski with all the advantages of its particular conformation of a ski formed in two parts.

Should the ski be required to be folded in order to reduce its dimensions, for example when it has to be carried on the shoulders or in a motor vehicle, in the condition of minimum bulk as shown in FIG. 2, it is sufficient to disengage the hooking elements 20 and 25 to fold the front slide 11 with the arm 14 on one side, parallel and against the lower surface of the rear slide 12. In these conditions shown in FIGS. 2 and 4, the length of the ski is substantially reduced, slightly greater than that of the rear slide, that is to say it is reduced by 30–40% of the overall length of the ski, with a considerable reduction in bulk, which enables the folded ski to be placed easily in the rear boot of the motor vehicle.

Figure 5:
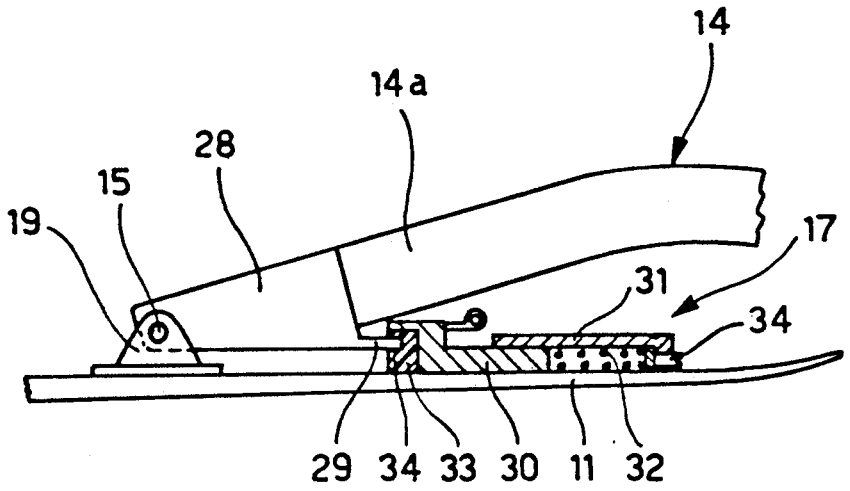
FIG. 5 shows a first variation of the hooking means for connecting the intermediate link arm and one of the slides of the ski.

FIG. 5 of the drawings shows an example of a first variation of the means for limiting the movement and for hooking the intermediate arm 14 and the front slide 11 which, suitably modified, could be adapted to hook also the rear slide 12.

Here too the arm 14 is hinged in 15 to a bracket 19 having a different shape compared to the bracket in the previous example. In particular, the front end 14*a* of the link arm is fixed to a connecting part or fitting 28 having a projection rim 29 directed rearwardly towards a slider 30 carried in a housing 31 fixed to the front slide 11; the slider 30 is biased forwards, towards the hinge 15 of the arm 14, by a spring 32 situated in the housing 31. This slider 30 brings to its front end a pad 33 in elastomeric material, having on its front face a transverse groove 34 which engages with the edge of the rim 29 of the fitting 28 connected to the arm 14. The pad 34 acts as means for limiting the movement and as biasing means in both the directions of relative rotation between the arm 14 and the front slide 11; in this case, by acting on the slider 30 to make it move backwards, overcoming the action of the opposing spring 32, it is possible to disengage the arm 14 from the front runner 11 to enable the ski to be folded. The thrust of the spring 32 can be suitably adjusted for example by acting on a dowel or a screw 34 at the rear end of the housing 31, against which the spring 32 rests, or in another suitable manner.

Figure 6:
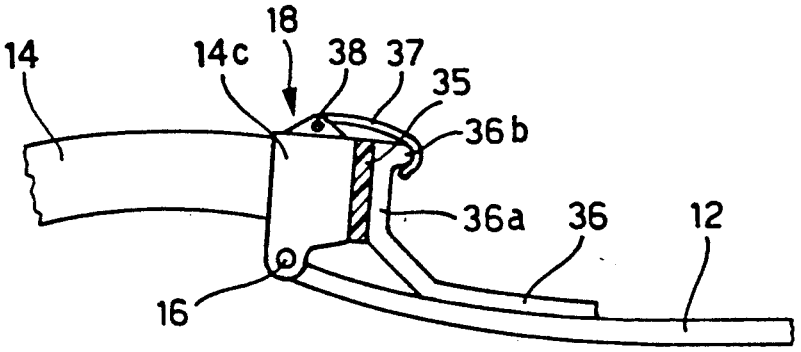
FIG. 6 shows a second embodiment of the hooking means for coupling the intermediate link arm and one of the slides of the ski.

FIG. 6 shows a further variation in the means 18 for limiting movement and for hooking between the arm 14 and the rear slide 12 which, suitably modified, can be adapted to hook the arm 14 to the front slide 11. In this case the connecting part **14*c* hinged in 16 to the front end of slide 12, has been modified compared to the example in FIG. 3 envisaging a flat pad 35 in elastomeric material designed to come into contact with the flat face 36*a* of a bracket 36 fixed in proximity of the tip of slide 12**.

The upwardly turned end or face **36*a* of the bracket, has a projecting transverse edge 36*b* which engages with a hooking element 37 hinged in 38 on the side of the connecting part or fitting 14*c*, which is opposite the hinging 16 of the rear slide 12. In this case too by engaging and disengaging the hooking means 37 it is possible to lock the arm and therefore the two slides 11 and 12 in a position of longitudinal alignment for use of the ski, or in the folded position for minimum bulk. As in the previous case in FIGS. 3 and 4, the function of limiting movement of rotation in both directions is performed in unison by the hooking element 37 and the pad 35 placed between opposite surfaces of the bracket 36 and the hinging part 14*c* of the arm 14**.

Figure 7:
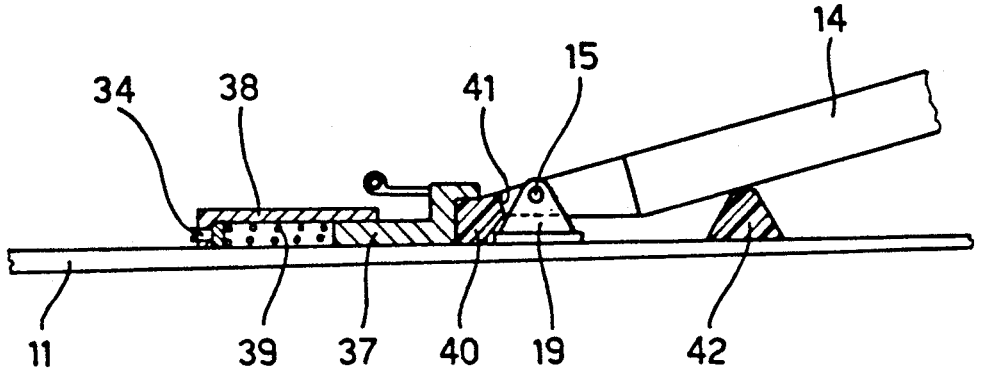
FIG. 7 shows a further embodiment of the hooking means for coupling the intermediate arm and a slide of the same ski.

FIG. 7 of the drawings shows a fourth solution particularly suitable for hinging the arm 14 and the front slide 11, which can be used together with any of the previous solutions. In this case too, similarly to the example in FIG. 5, use is made of a hooking element in the form of a slider 37 which slides in a housing 38 fixed to the front slide 11 and is subjected to the biasing action of an opposing spring 39 which may if required be adjusted similarly to the spring 32 of FIG. 5. The slider 37 has at the front a pad 40 in elastomeric material, having a slanted front surface 41 designed to come into contact with a similarly slanted surface at the front end of the arm 14 or part of the arm itself which extends a short distance beyond the hinge 15. A second pad 42 in elastomeric material is placed in front of the slide 11, opposite pad 40, in relation to hinge 15, so that the two elastic pads 40 and 42 act together to restrict the movement of rotation of the arm 14 in relation to slide 11 in both directions of rotation. It is in any case clear that the elastic pads of the various solution could be replaced with other equivalent means, whose degree of elasticity can be varied or adapted according to specific requirements; in particular it is advisable to maintain a certain elastic behaviour of the hooking parts for the front slide, whereas for the rear slide it may be preferable to have a rigid restraint at the same time maintaining the folding feature of the ski which constitutes the essential and innovatory characteristic of this invention.

Figure 8:
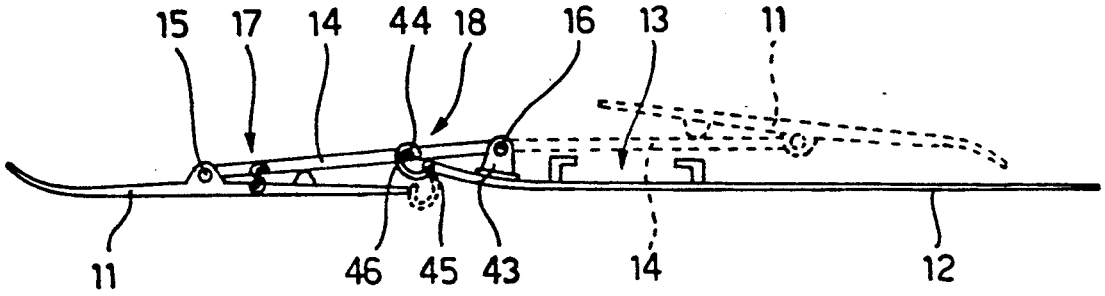
FIG. 8 shows a further embodiment of the ski according to the invention.

FIG. 8 of the drawings shows another solution of the foldable ski, in which the front slide 11 and the intermediate link arm 14 can be folded above the rear slide 12. This solution has some advantages over the previous solutions even if it partially increases the bulk in width of the folded ski. In fact as well as achieving greater reduction in length of the ski when folded, it enables a rectilinear configuration of the arm 14 to be adopted, simplifying its construction, leaving the remaining characteristics of the ski basically unchanged.

Therefore, also in the case of FIG. 8, the ski comprises a front slide 11 and rear slide 12 connected to each other by an intermediate arm 14 hinged in 15 and 16 respectively to the two slides of the ski. In this case the arm 14 can be composed, as already stated, of a rectilinear tubular member which does not require bending and is therefore easy to construct. The link arm 14 is hinged in 15 to the front slide 11 and is also connected to it by means of an elastic biasing device 17 for restricting movement comprising an hooking which can be engaged and disengaged according to any of the solutions illustrated previously.

Unlike the previous case, the arm 14 is hinged in 16 to the rear slide 12 by means of a bracket 43 fixed behind the front edge of the tip of the ski, between the binding 13 for the ski-boot and the tip of the ski itself. An hooking member generically indicated by 44, is hinged in 45 at the tip of the ski and engages with side pins 46 fixed to the intermediate arm 14. In the case in FIG. 8, a generical pivotable hooking element, simplified by way of an example, is illustrated, nevertheless other solutions are obviously feasible provided they are suitable for the intended purpose.

From what has been stated and shown in the annexed drawings, it is therefore clear that we are dealing with a foldable ski structure comprising a front slide, a rear slide and an intermediate linking arm hinged to the two slides, and which can also be connected to these by movement limiting means comprising hooking element or elements which can be engaged and disengaged to enable one slide to be folded against another. The connection between the slides and the intermediate arm should preferably have an elastic action for the front slide, and a rigid action for the rear slide; furthermore, according to the arrangement of the rear hinge at the tip of the slide or behind, it is possible to fold the ski by positioning the front slide above or below the rear slide. In every case, an innovatory structure of a foldable ski is provided, which cannot be achieved with other known ski structures, with the advantage of allowing a reduction in the length of the ski, when the latter has to be transported, maintaining the functional features of a conventional ski.

What is claimed is:

1. A foldable ski, comprising:

a front slide having an upwardly turned tip portion;

a rear slide having an upwardly turned tip portion;

an intermediate link arm;

hinge means for connecting said link arm to said front and rear slides, said hinge means including a first hinge connecting said link arm to said front slide and a second hinge connecting said link arm to said rear slide, said hinge means being dimensioned and arranged so as to maintain said front and rear slides longitudinally aligned;

movement limiting means for limiting the movement between said link arm and said front and rear slides, said movement limiting means including first and second hooking members, said first hooking member adapted for releasibly engaging said front slide with said link arm, said second hooking member having a hinge connection joining said hooking member with said rear slide, said second hooking member being adapted for engagement with said link arm and disengagement from said link arm, and the hinge axis of the hinge connection joining said second hooking member with said rear slide is longitudinally spaced from the hinge axis of said second hinge along the tip portion of the rear slide, and said first and second hooking members being readily engageable into a movement limiting mode and disengageable such that said front and rear slides are adapted to be foldable upon one another into a storage mode.

2. A foldable ski as in claim 1, wherein said second hinge is positioned behind the front end of the rear slide, and said second hooking member is positioned at the front end of the rear slide.

3. A foldable ski as in claim 2, wherein said second hooking member comprises a hooking element of rigid nature.

4. A foldable ski as in claim 2, wherein said second hooking member comprises an elastic hooking element.

5. A foldable ski as in claim 2, wherein said intermediate link arm has a rectilinear shape.

6. A foldable ski as in claim 1, wherein said movement limiting means comprises at least one elastic pad member.

7. A foldable ski as in claim 1, wherein said link arm is arch shaped and is hinged at the front end of the rear slide.

8. A foldable ski as in claim 1, wherein said movement limiting means comprises a pad member of elastomeric material projecting from one end of the arm, said foldable ski further comprising a thrust member being provided near the tip portion of the rear slide, and said second hooking means extending between said pad member and said thrust member when said second hooking means is engaged.

9. A foldable ski as in claim 1, wherein said movement limiting means comprising a stop member of elastomeric material positioned on said front slide and said first hooking member extending between said front slide and said link arm.

10. A foldable ski as in claim 1, wherein said first hooking member is in the form of a slider engageable and disengageable with said link arm, said first hooking member further comprising biasing means to maintain the slider engaged with said arm.

11. A foldable ski as in claim 10, wherein said slider includes an elastomeric member and is positioned between the rear end of the front slide and said first hinge, and said link arm comprising a rearwardly projecting portion which extends into a groove formed in said elastomeric pad member of said slider.

12. A foldable ski as in claim 10, wherein said slider includes a front extension and is positioned forward of said first hinge, said slider further including an elastomeric pad member abutting the front extension of said link arm, said extension of the arm and said elastomeric pad member having slanted abutting surfaces.

13. A foldable ski as in claim 1, wherein both said front slide and the intermediate link arm, in the folded condition of the ski, are positioned on a bottom side of the rear slide.

14. A foldable ski as in claim 13, wherein said front slide and said intermediate link arm, when in a folded state, are essentially parallel to the rear slide.

15. A foldable ski as in claim 1, wherein said front slide and the intermediate link arm, when in the folded condition, are arranged essentially longitudinally on an upper side of the rear slide.

* * * * *